United States Patent [19]

Chen et al.

[11] Patent Number: 4,776,884

[45] Date of Patent: Oct. 11, 1988

[54] PROCESS FOR DETERMINING THE ARRANGEMENT OF THE LAYERED CHARGES IN A BLAST FURNACE PRIOR TO SMELTING

[75] Inventors: Chung-Mei Chen, Kaohsiung; Jenn-Fu Yang, Kaohsiung Hsien; Chang-Chun Lin, Kaohsiung; Seng-Her Hong, Pingtung Hsien, all of Taiwan

[73] Assignee: China Steel Corporation, Kaohsiung, Taiwan

[21] Appl. No.: 52,020

[22] Filed: May 19, 1987

[51] Int. Cl.[4] ..... C21B 7/24

[52] U.S. Cl. ..... 75/41; 75/42; 266/92; 324/208; 324/226

[58] Field of Search ..... 266/92; 75/41, 42; 324/208, 226

[56] References Cited

U.S. PATENT DOCUMENTS 4,122,392 10/1978 Takeuchi et al. ..... 266/92
4,123,707 10/1978 Fujii et al. ..... 266/92

FOREIGN PATENT DOCUMENTS 2655297 9/1977 Fed. Rep. of Germany ..... 266/92
3042103 6/1981 Fed. Rep. of Germany ..... 75/41

*Primary Examiner*—Melvyn J. Andrews
*Attorney, Agent, or Firm*—Ladas & Parry

[57] ABSTRACT

A process for determining the arrangement of the layered charges in a blast furnace prior to smelting. Positioned in the layered charges in the blast furnace are a plurality of upright tubes in each of which an eddy current probe is moved up and down. The layered charges are composed of alternate layers of coke and sintered iron ore. A first set of data indicating the position of the probe is obtained through an encoder, a position counter and a recorder. A second set of data indicating the content of the sintered iron ores in the charges at any level is obtained through an eddy current tester and the recorder due to the fact the sintered iron ores and the cokes are of different magnetic permeabilities. By contrasting the first set of data with the second set of data, the distribution of the sintered iron ores in the charges is detected.

5 Claims, 14 Drawing Sheets

| TUBE | | PEAK 1 | PEAK 2 | PEAK 3 | PEAK 4 | PEAK 5 | UNIT |
|---|---|---|---|---|---|---|---|
| NO.1 | H | 0.152 | 0.15 | 0.17 | 0.07 | 0.145 | VOLT |
| | W | 80 | 110 | 140 | 140 | 260 | MM |
| | P | 100 | 720 | 1450 | 2300 | 3090 | MM |
| NO.2 | H | | | | | 0.78 | VOLT |
| | W | | | | | 270 | MM |
| | P | | | | | 3030 | MM |
| NO.3 | H | 0.052 | 0.078 | 0.078 | 0.035 | 0.08 | VOLT |
| | W | 140 | 270 | 240 | 140 | 420 | MM |
| | P | 200 | 820 | 1520 | 2380 | 2920 | MM |
| NO.4 | H | 0.083 | 0.096 | 0.107 | 0.099 | 0.185 | VOLT |
| | W | 170 | 230 | 270 | 180 | 340 | MM |
| | P | 260 | 930 | 1410 | 2420 | 2850 | MM |
| NO.5 | H | 0.185 | 0.124 | 0.098 | 0.113 | 0.185 | VOLT |
| | W | 250 | 210 | 320 | 220 | 370 | MM |
| | P | 270 | 910 | 1560 | 2400 | 2810 | MM |
| NO.6 | H | 0.227 | 0.201 | 0.20 | 0.237 | 0.202 | VOLT |
| | W | 280 | 230 | 310 | 420 | 280 | MM |
| | P | 245 | 925 | 1600 | 2370 | 3065 | MM |
| NO.7 | H | 0.189 | 0.190 | 0.221 | 0.217 | 0.138 | VOLT |
| | W | 120 | 150 | 210 | 350 | 330 | MM |
| | P | 180 | 760 | 1365 | 2180 | 2785 | MM |
| NO.8 | H | 0.192 | 0.208 | 0.23 | 0.119 | 0.21 | VOLT |
| | W | 180 | 170 | 210 | 230 | 290 | MM |
| | P | 285 | 910 | 1585 | 2180 | 3145 | MM |

FIG. 14

PROCESS FOR DETERMINING THE ARRANGEMENT OF THE LAYERED CHARGES IN A BLAST FURNACE PRIOR TO SMELTING

BACKGROUND OF THE INVENTION

The present invention relates to a process for determining the arrangement of the layered charges in a blast furnace, and more particularly to one which is used for detecting the distribution of a sintered iron ore containing ferromagnetic material in the layered charges in the blast furnace prior to smelting.

It is known that the utilization of alternately layered charges of coke and iron ore is inherent to achieving a more efficient smelting operation. Additionally, it has been determined that an increased production of pig iron be realized by carefully monitoring the quantity of coke used to complete the production process. It is thus worthwhile to detect and analyze the distribution of the sinter and coke in the charges in a blast furnace.

SUMMARY OF THE INVENTION

It is therefore the main object of the present invention to provide a process for determining the arrangement of the layered charges in a blast furnace prior to smelting.

Generally, the main difference between electromagnetic property of ferromagnetic material and non-ferromagnetic material is their magnetic permeabilities. It is known that magnetic permeability is greater than unity for ferromagnetic material and is equal to unity for non-ferromagnetic material. Based on this fact, it can be understood that coke and sinter containing ferromagnetic material may be distinguished by electromagnetic methods.

It is therefore the main feature of the present invention to move an eddy current probe longitudinally relative to the layered charges in a blast furnace so that the content of sinters in the charges at any level can be detected.

According to the present invention, a process for determining the arrangement of the layered charges in a blast furnace prior to smelting is provided, said layered charges being formed by layers of iron ore and layers of coke alternately overlying each other, said process comprising the steps of:

(1) charging the blast furnace with at least one of said charge layers;

(2) positioning a plurality of upright tubes on said charged layer in the blast furnace;

(3) continuing to charge alternately said iron ore and said coke in a like manner so as to form said layered charges without overlying the upper opening end of each of said upright tubes;

(4) activating a probe means by providing a driving means to move up and down in each of said upright tubes, said probe means being capable of responding to the quantity of ferromagnetic material in a range by an electromagnetic signal so that said probe means will respond to the content of said iron ore in said charges at any level;

(5) obtaining a first set of data from the position of each of said probe means in a first data generating means;

(6) obtaining a second set of data from the content of said iron ore in said charges at any level in a second data generating means; and (7) inputting said first and second sets of datum into a recording means for being processed so that distribution of said iron ore in said charges is determined.

Preferably, the upright tubes are disposed in a spiral arrangement around the center of said blast furnace which prevents the charges from accumulating in undesirable areas in the blast furnace.

BRIEF DESCRIPTION OF THE DRAWINGS

Other features and advantages of the present invention will become apparent from the following detailed description of the preferred embodiment of the present invention with reference to the accompanying drawings in which:

FIG. 14 is a set of data obtained from FIGS. 6–13.

DETAILED DESCRIPTION OF THE PREFERRED EMBODIMENT

As is well known in the art, the charges in a blast furnace are provided in layers. All the layers are charged in the same manner. When burned, the lowermost layers are liquefied so that the remaining layers move progressively downwardly. The charges are composed of a plurality of sinter-coke mixture layers each of which consists of a sinter layer and a coke layer.

Figure 1:
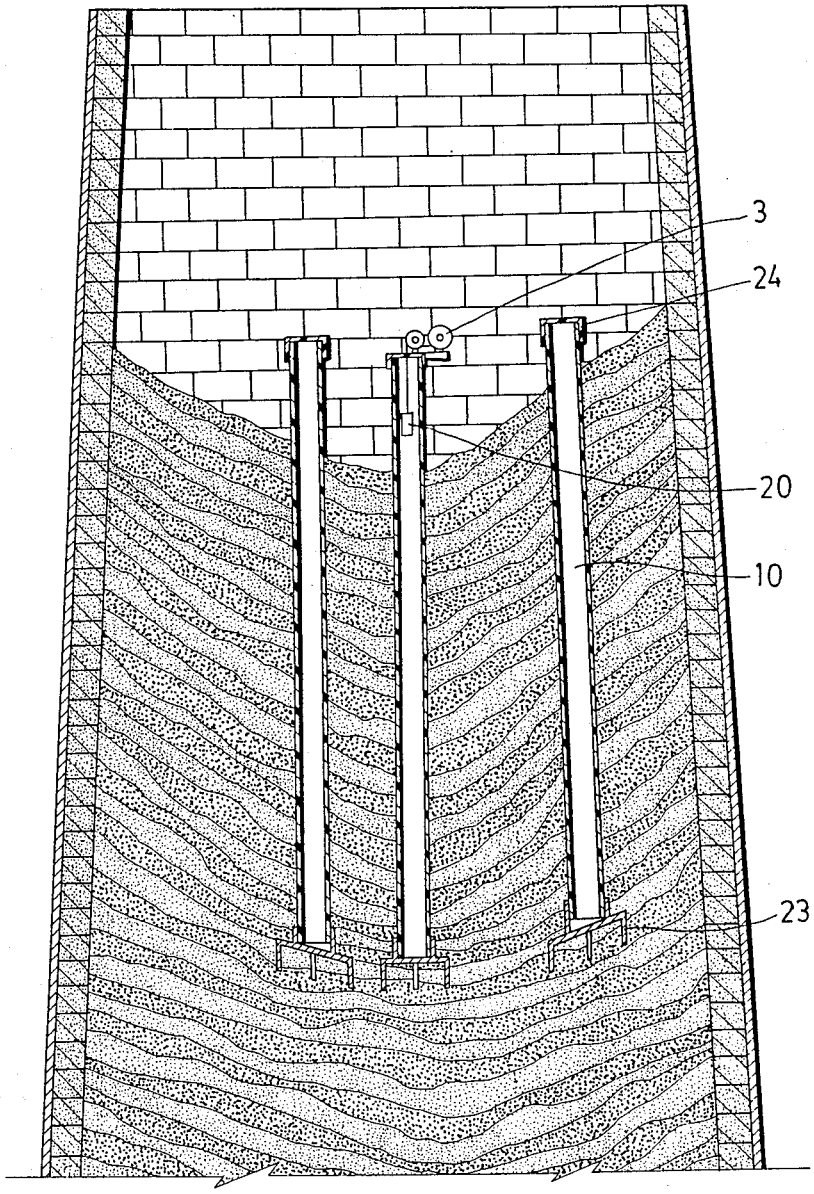
FIG. 1 is a vertical sectional view of a blast furnace in which the layered charges are detected by a process according to the present invention, in which only one eddy current probe is shown.
Figure 2:
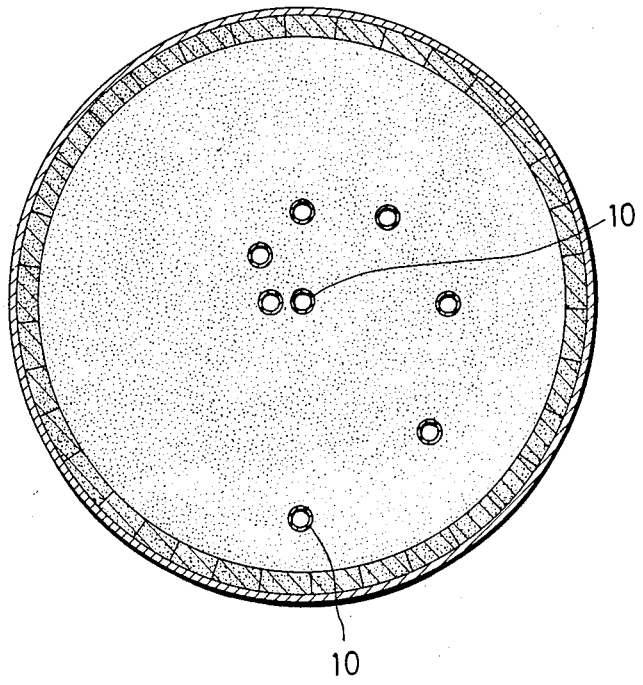
FIG. 2 is a horizontal sectional view of the blast furnace in which the layered charges are detected by the process of the present invention and in which eight upright tubes are provided, viewed from the top.
Figure 3:
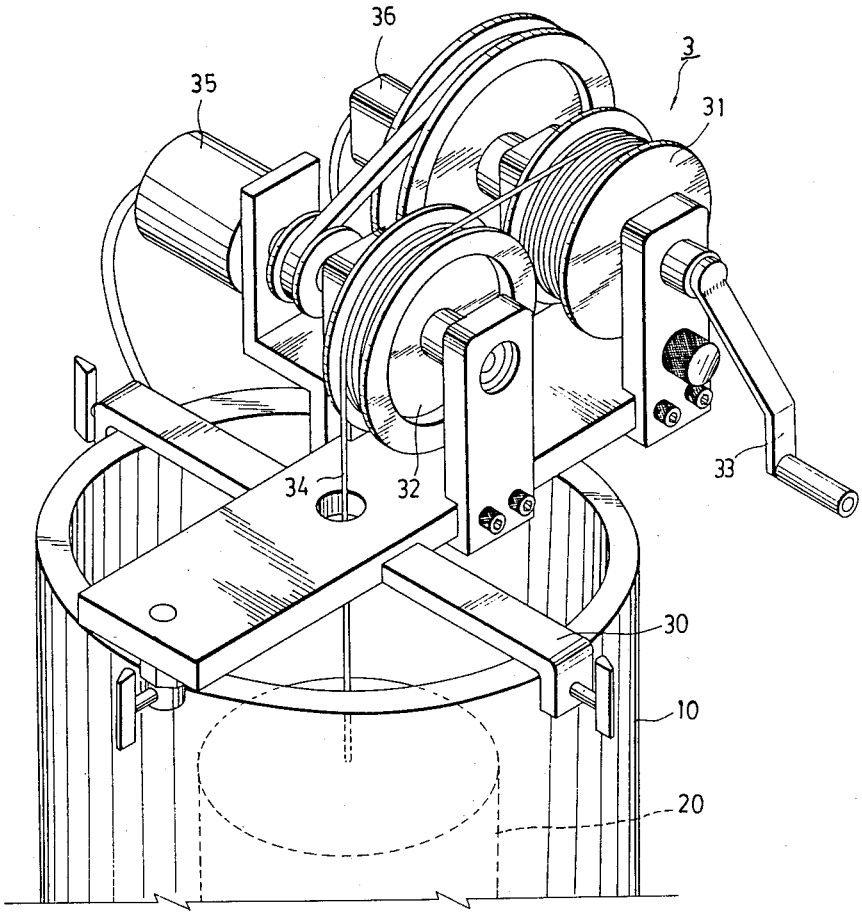
FIG. 3 is a perspective view of a driving means installed on the upper opening end of an upright tube in the blast furnace in which the layered charges are detected by the process of the present invention.

Referring to FIG. 1 with reference to FIGS. 2 and 3, to achieve a process according to the present invention, after six sinter-coke mixture layers have been charged, eight upright plastic tubes 10 are placed on the sixth sinter-coke layer in a spiral arrangement, as shown in FIG. 2. Since this spiral arrangement of the upright tubes 10 can prevent the charges from accumulating in a certain regions in the blast furnace, particularly in the center of the blast furnace, the charges have an advantageous spread. Each of the upright tubes 10 is provided with a cap 24 sleeved removably on the upper end thereof in order to prevent cokes from falling into the upright tubes 10 through the upper opening of the same during subsequent charging process. In addition, each of the upright tubes 10 has a mounting steel base 23 which includes a sleeve for receiving one of the upright tubes 10 therein and four vertical legs (only three are seen in FIG. 1) secured to the lower end of the sleeve and disposed in a criss-cross arrangement for being inserted tightly into the sixth layer of sinter-coke mixture.

As illustrated, regarding the bases 23 of the upright tubes 10, each leg is inclined at a predetermined angle relative to its sleeve and coinciding with the gradient of the sixth layer of sinter-coke mixture at the position thereof. This permits the upright tubes 10 stands firmly on the sixth layer of sinter-coke mixture.

Subsequent to the insertion of the upright tubes 10, additional layers of sinter-coke mixture are charged in a like manner until the layers reach a predetermined level while still permitting the upper ends of the upright tubes 10 to extend above the charged layers of the mixture.

When the charging operation of the sinter-coke mixture layers is completed, the caps 24 are removed from the upright tubes 10. Referring to FIGS. 1 and 3, a driving means 3 is then mounted on the upper end of each of the upright tubes 10. An eddy current probe 20 used as a sensor is controlled by the driving means 3 to move up and down in each of the upright tubes 10.

As seen more clearly from FIG. 3, the driving means 3 includes a criss-cross bearing member 30 fixed on the upper end of the upright tube 10, a winch 31 drivable by a rocker 33, a cable 34 wound on the switch 31 for hanging the eddy current probe 20 on the free end of the cable 34, a guide pulley 32 mounted rotatably on the bearing member 30 for guiding the cable 34 into the upright tube 10. Incorporated with the driving means 3 are a shift counter 35 connected to the guiding wheel 32, and a variable resistance component 36 connected to the winch 31. Both of the shift counter 35 and the variable resistance component 36 constitute an encoder. When the longitudinal movement of the eddy current probe 20 in the upright tube 10 causes the guide pulley 32 to rotate, the encoder senses the rotational movement of the guide pulley 32 to output a signal to a position counter (not shown) which will therefore show the digital position information of the eddy current probe 20.

It is known in the electromagnetic technique field that the eddy current probe is substantially a sensor with internal coils. When the coils are energized, a magnetic field is produced around the eddy current probe. When the eddy current probe moves near the interface of a ferromagnetic material and a nonferromagnetic material, the magnetic field intensity is varied, thereby changing the magnetic flux density and in turn changing the electromotive force. Based on this principle, when the eddy current probe 20 of the preferred embodiment moves up and down within the layers of sinter-coke mixture, the electromagnetic signal resulting from the change of the magnetic flux density can show the distribution of the sinters in the charges in a blast furnace.

Figure 4:
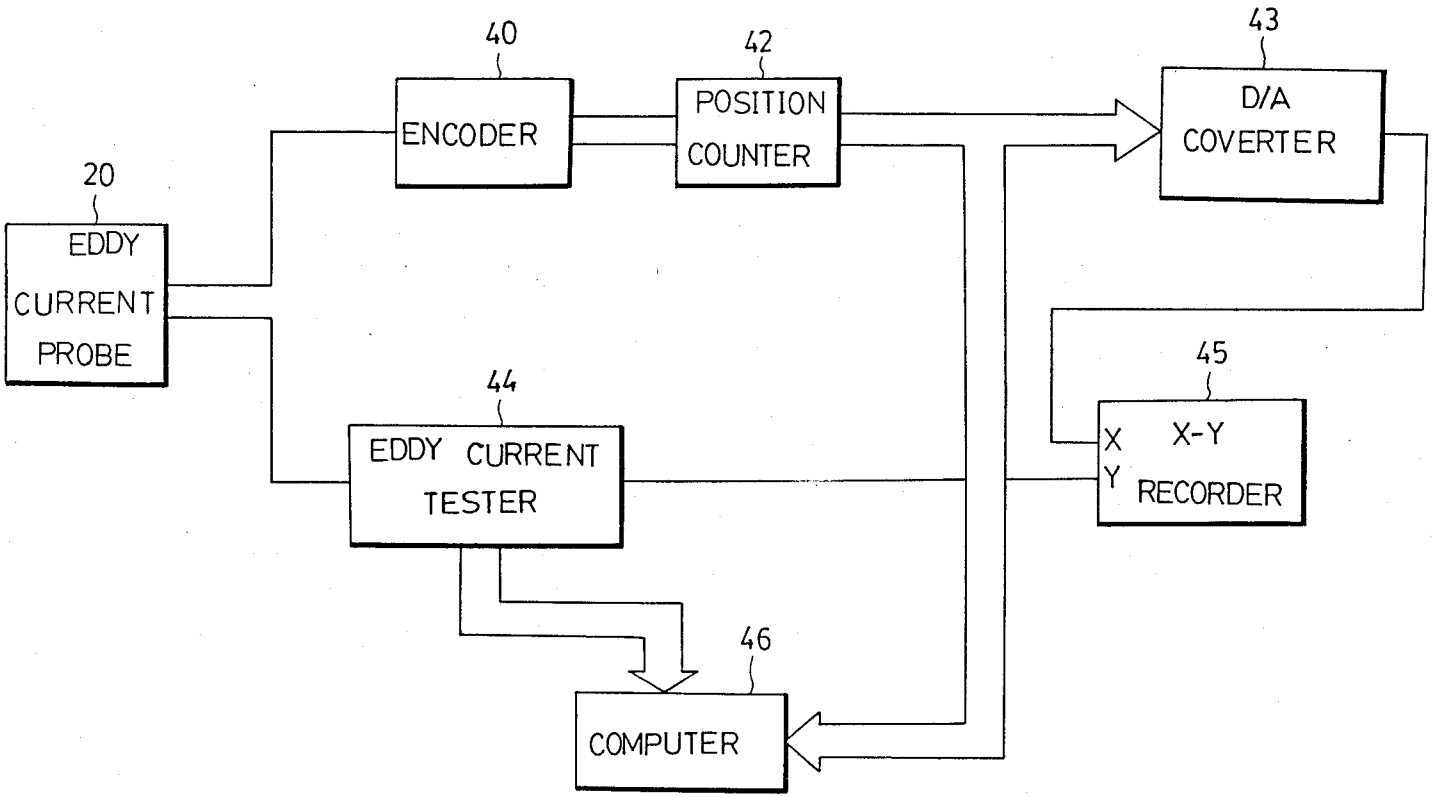
FIG. 4 is a function block diagram illustrating the process of the present invention.

Referring to FIG. 4, the desired information is obtained along two operative lines. On one hand, the position of the eddy current probe 20 is sensed by the encoder 40 so that a position counter 42 connected to the encoder 40 outputs a digital position data to a position digital/analog converter 43. Then, an analog position data from the converter 43 is output to the X input terminal of an X-Y recorder 45. The position data is stored in a computer 46. On the other hand, the electromagnetic signal resulting from the change in magnetic flux density is converted into a digital signal and an analog signal by an eddy current tester 44. The analog signal from the tester 44 is transferred to the Y input terminal of the X-Y recorder 45. The digital signal from the tester 44 is transferred to the computer 46 by an IEEE-488 standard interface and thus stored in the computer 46.

Figure 5:
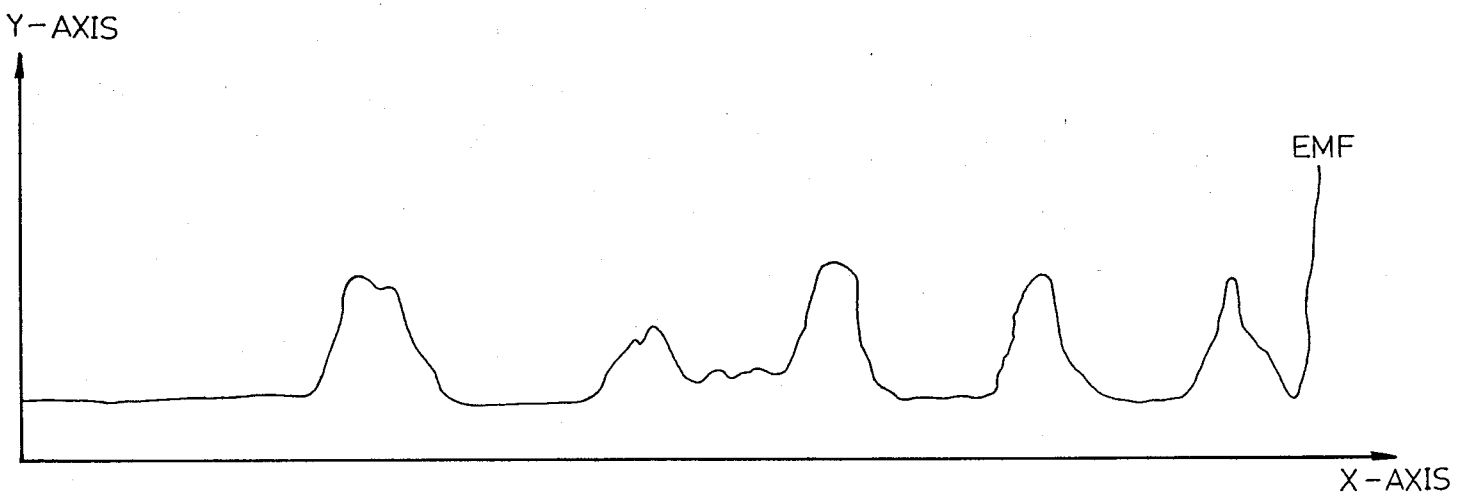
FIG. 5 is a graph illustrating the information obtained in an X-Y recorder by the process of the present invention, wherein X-axis indicates the position of an eddy current probe and Y-axis indicates the induced electromotive force thereof.
Figure 6:
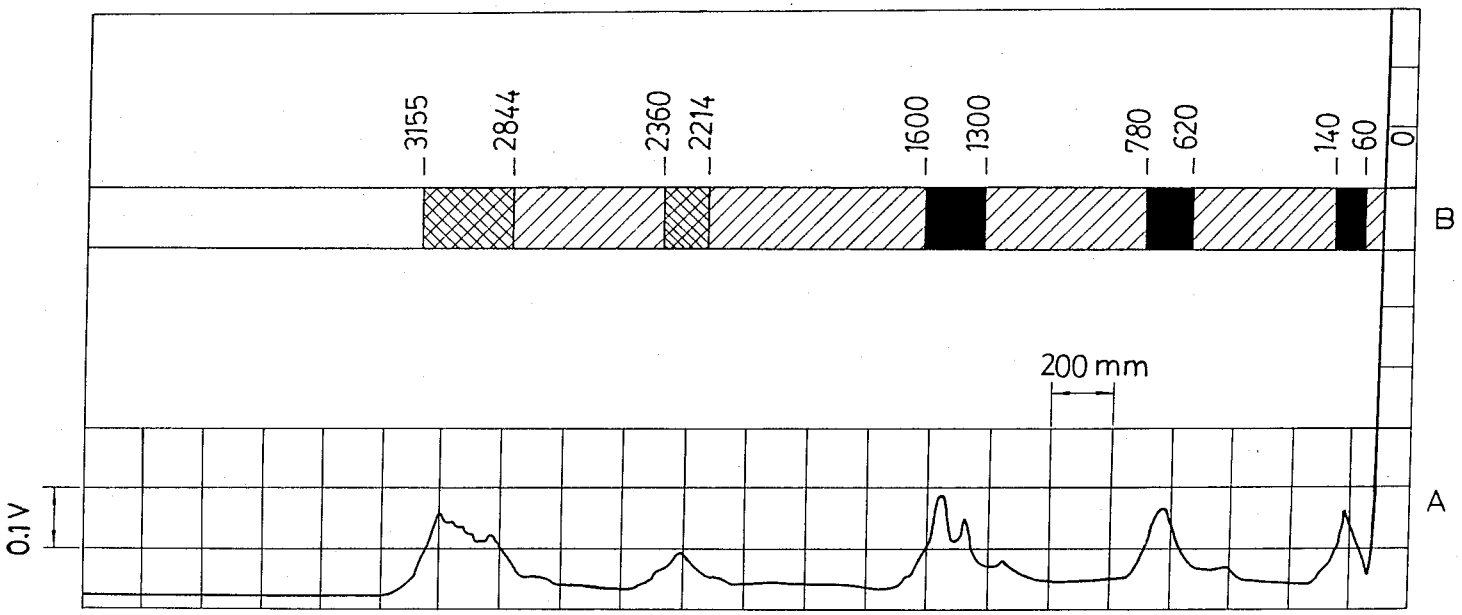
FIGS. 6 to 13 are eight graphs similar to FIG. 5, showing the detection information derived from the eddy current probes disposed movably in the respective upright tubes of FIG. 2.
Figure 7:
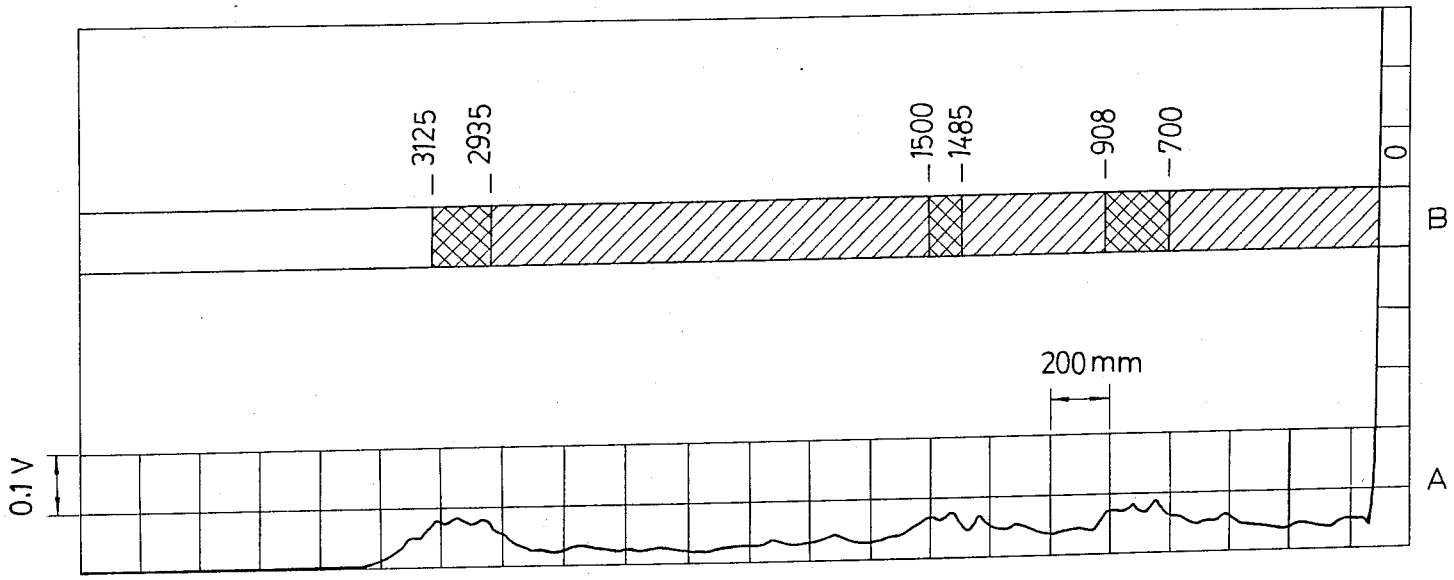
Figure 8:
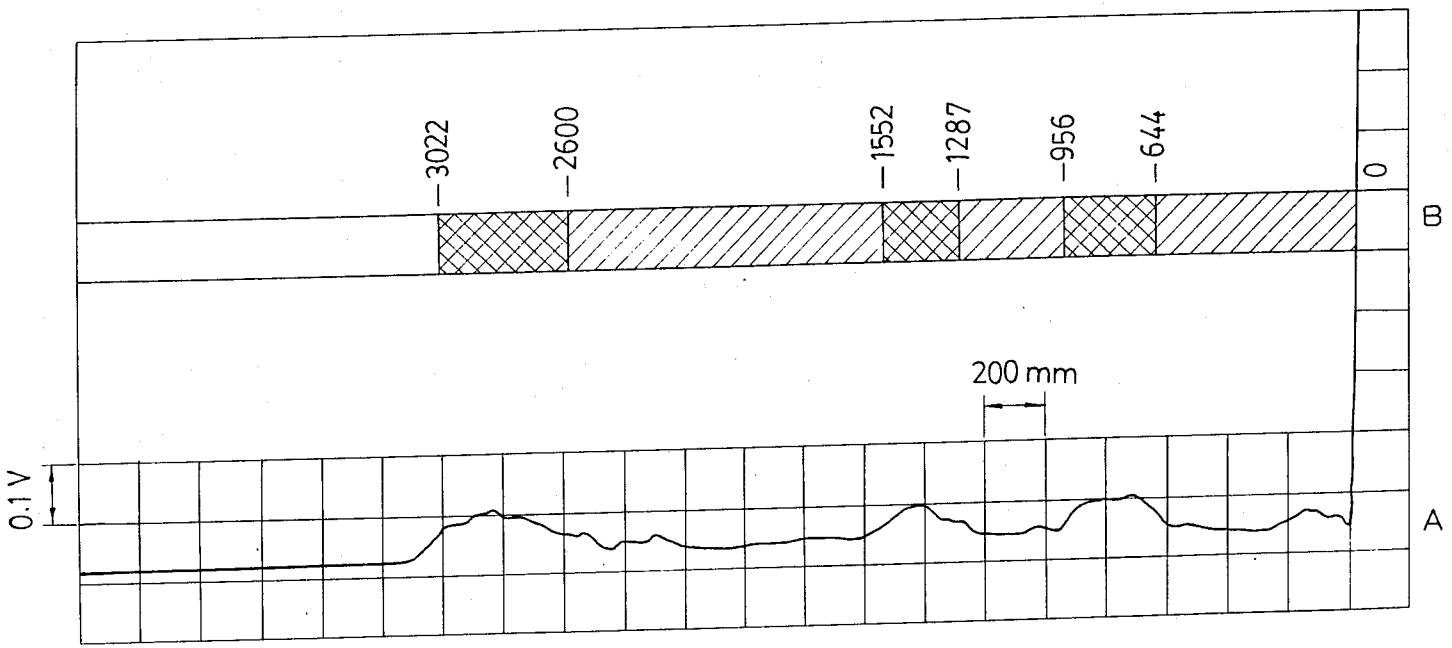
Figure 9:
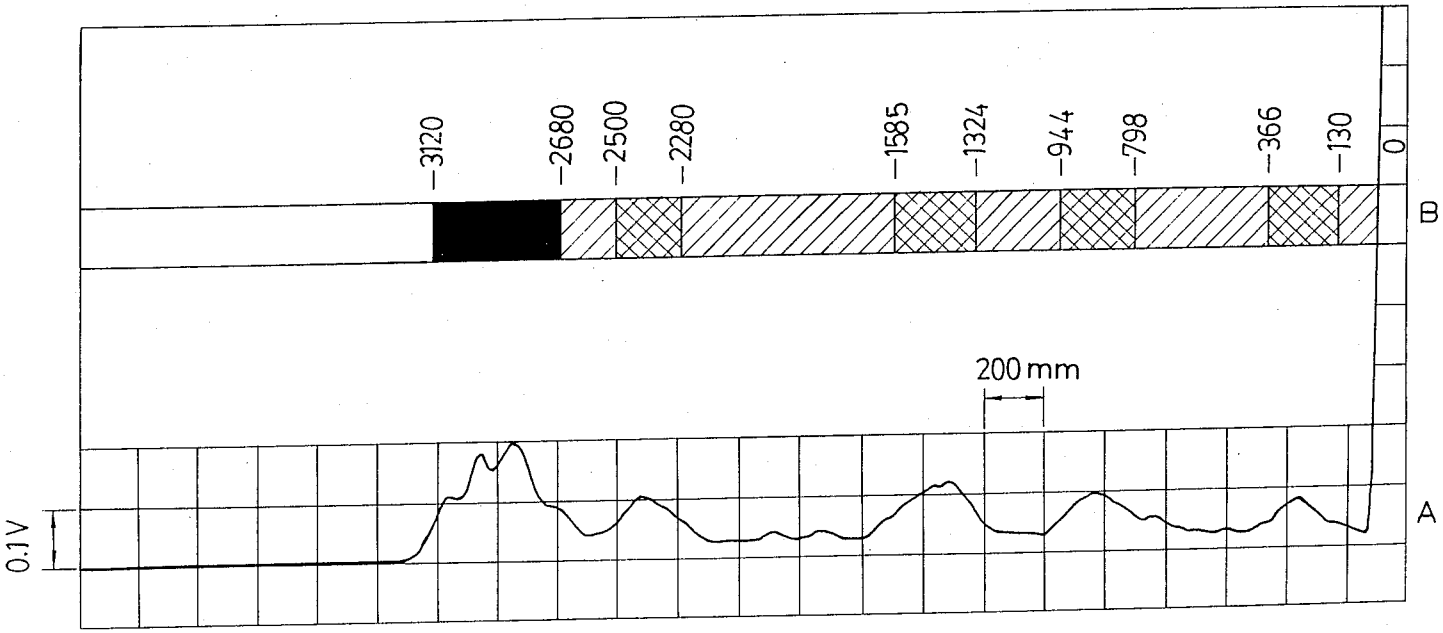
Figure 10:
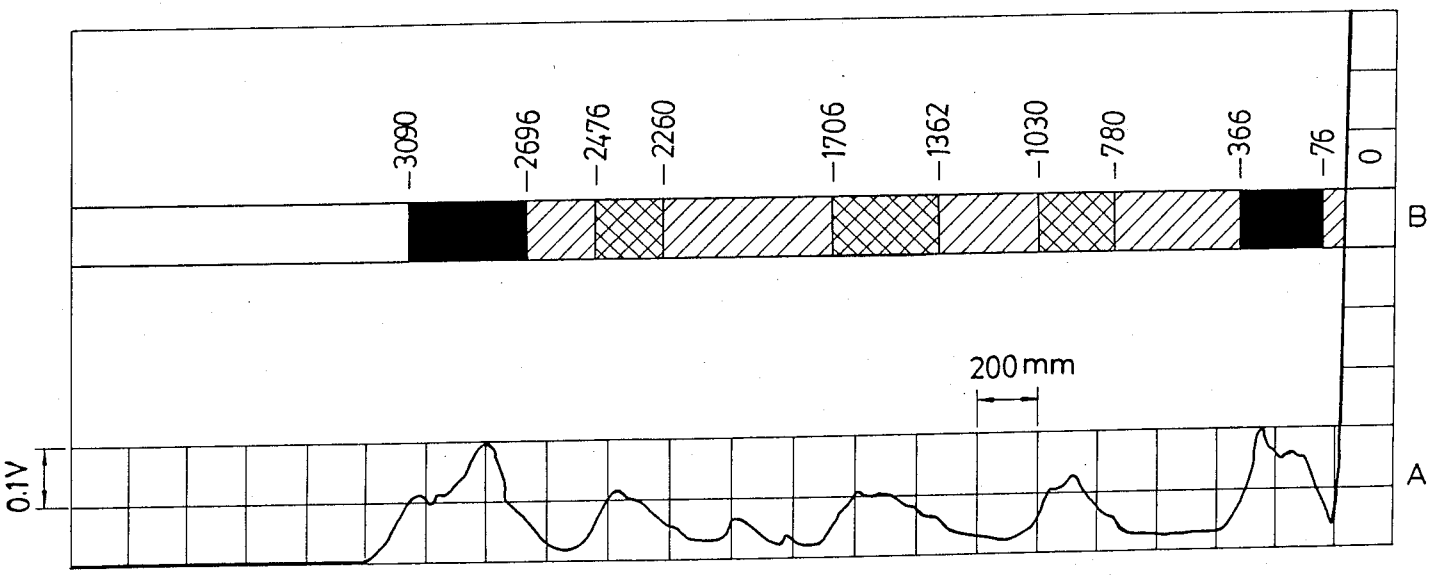
Figure 11:
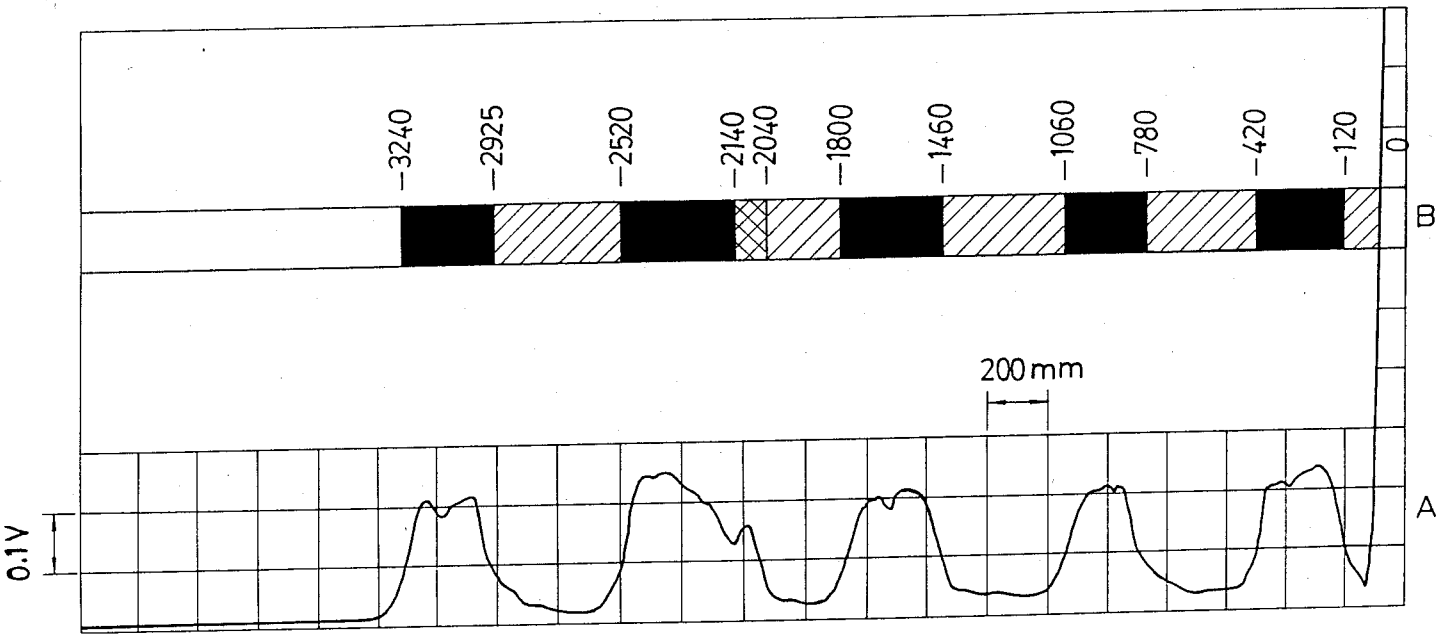
Figure 12:
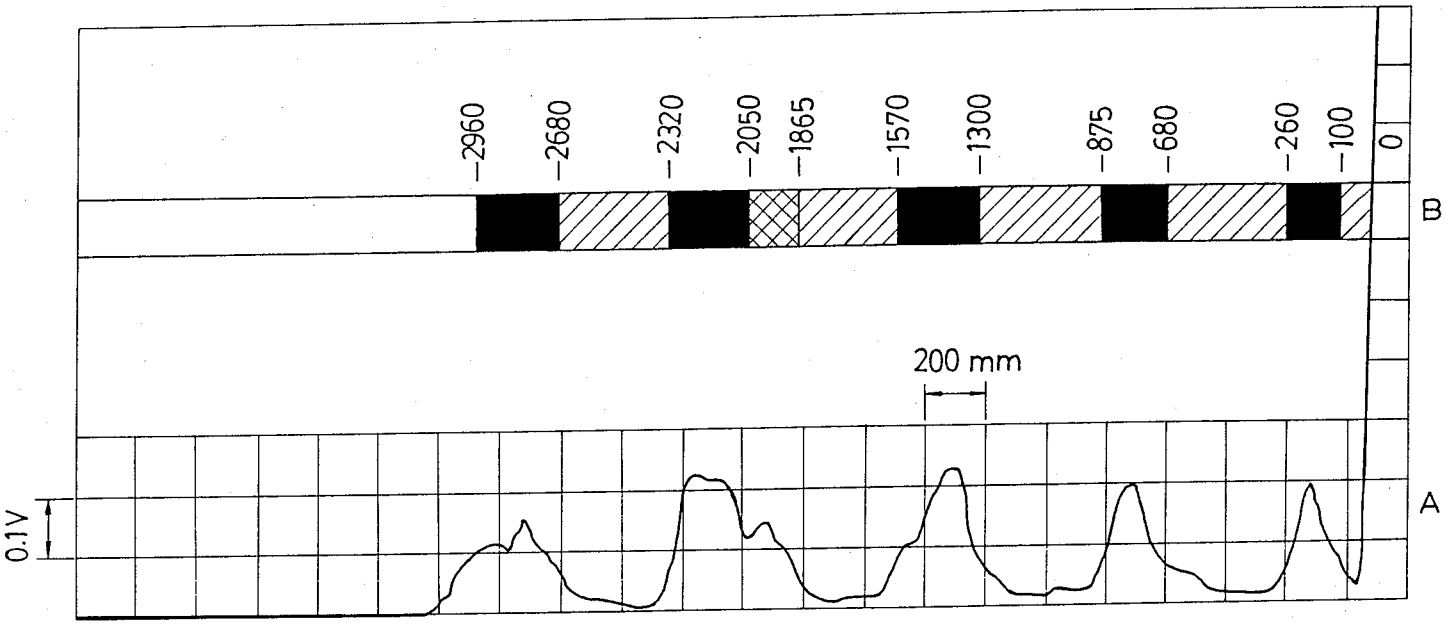
Figure 13:
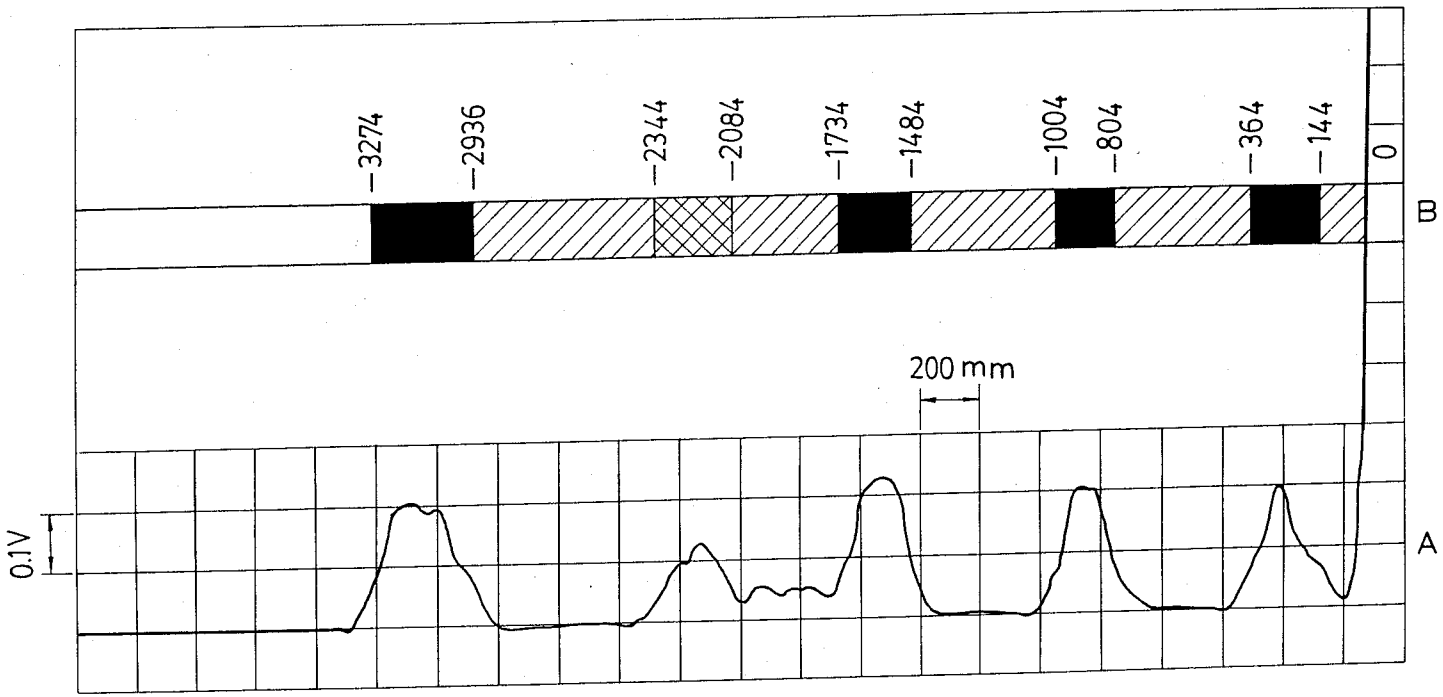

As for the information input to the X-Y recorder 45, it defines a graph, as shown in FIG. 5. In the graph, its X-axis indicates the position of the eddy current probe 20 and its Y-axis indicates the electromagnetic signal from the eddy current probe 20. In the preferred embodiment, the information recorded in the recorder 45, which is detected in the eight upright tubes 10 from the innermost one to the outermost one, is shown on graph A in FIGS. 6 to 13. The A graphs can be converted into the B graphs in accordance with the thicknesses of the sinter layer and the coke layer. In the B graphs, the solid black regions indicate that the content of the sinters in the sinter-coke mixture is greater than about 75%, the crisscrossing line regions indicate that the content of the sinters in the sinter-coke mixture ranges from about 25% to about 75%, and the diagonal line regions indicate that the content of the sinters in the sinter-coke mixture is less than about 25%.

Additionally, a set of data made from the A graphs of FIGS. 6–13 is shown in FIG. 14, which lists the heights and the widths of the peaks, and denotes the position thereof relative to the upright tube bases 23. In this table, the first upright tube is the innermost one and the eighth upright tube is the outermost one.

It has been found that in those layers above the sixth layer of sinter-coke, the sinters were mainly spread on the outer ring, the radius of which ranges from 2.5 meters to 4 meters, where the wall of the blast furnace is positioned. Also, the sinters inside the outer ring were found to be fewer and mixed with the cokes quite well.

As explained in the foregoing, the process of the present invention is practical. The charging technique and the structure of the blast furnace may be improved based on the subsequent detection effected by the process of the present invention being applied again and again.

The present invention thus explained, it is apparent that various modifications and variations can be made without departing from the scope and spirit of the present invention. It is therefore intended that the present invention be limited only as indicated in the appended claims.

What is claimed is:

1. A process for determining the arrangement of the layered charges in a blast furnace prior to smelting, said layered charges being formed by layers of iron ore and layers of coke alternatively overlying each other, said process comprising the steps of:

(1) charging the blast furnace with at least one of said charge layers;

(2) positioning a plurality of upright tubes on said charged layer in the blast furnace;

(3) continuing to charge alternately said iron ore and said coke in the same manner so as to form said layered charges without overlying the upper opening end of each of said upright tubes;

(4) activating a probe means by a driving means to move up and down in each of said upright tubes, said probe means being capable of responding to the quantity of ferromagnetic material in a range by an electromagnetic signal so that said probe means will respond to the content of said iron ore in said charges at any level;

(5) obtaining a first set of data from the position of each of said probe means in a first data generating means;

(6) obtaining a second set of data from the content of said iron ore in said charges at any level in a second data generating means; and (7) inputting said first and second sets of datum into a recording means for being processed therein so that distribution of said iron ore in said charges is determined.

2. A process as claimed in claim 1, wherein said probe means is an eddy current probe.

3. A process as claimed in claim 2, wherein said second data generating means includes an eddy current tester functionally connected to said eddy current probe for representing said second set of data.

4. A process as claimed in claim 1, wherein said driving means comprises a winch installed on the upper opening end of each of said upright tubes, and a cable wound on said winch and hanging said corresponding probe means from the free end thereof.

5. A process as claimed in claim 1, wherein said upright tubes in said blast furnace are positioned separately in a spiral arrangement around the center of said blast furnace so that the movement of said layered charges can be advantageously controlled.

* * * * *